United States Patent [19]

Traben

[11] Patent Number: 4,589,456

[45] Date of Patent: May 20, 1986

[54] APPARATUS FOR PRODUCING SQUARED TIMBERS BY MEANS OF NON-CHIP SEVERING OF BOARDS THEREFROM

[75] Inventor: Josef Traben, Oberkirch, Fed. Rep. of Germany

[73] Assignee: Gebrüder Linck, Maschinenfabric u. Eisengiesserei "Gatterlinck", Fed. Rep. of Germany

[21] Appl. No.: 676,000

[22] Filed: Nov. 29, 1984

[30] Foreign Application Priority Data

Nov. 28, 1983 [DE] Fed. Rep. of Germany ..... 3343294

[51] Int. Cl.[4] ..... B27L 9/00

[52] U.S. Cl. ..... 144/3 P; 83/404.4; 83/425.3; 144/120; 144/184

[58] Field of Search ..... 144/3 P, 114, 120, 130, 144/159, 184; 83/404.4, 370, 425.3

[56] References Cited

U.S. PATENT DOCUMENTS

| | | | |
|---|---|---|---|
| 1,009,688 | 11/1911 | Peterson et al. | 144/120 |
| 1,503,784 | 8/1924 | Dumont | 144/184 |
| 4,220,185 | 9/1980 | Traben | 144/3 P |

*Primary Examiner*—W. D. Bray

*Attorney, Agent, or Firm*—Hill, Van Santen, Steadman & Simpson

[57] ABSTRACT

An apparatus for producing squared timbers by means of severing portions or boards from opposite surfaces of the log without creating either chips or sawdust characterized by oscillatory opposed banks of staggered blade units with the blades of each unit extending progressively toward the axis of the log as the log passes therebetween. To provide improved surface quality of the boards produced, the apparatus has one of the banks of blades rigidly mounted in a first adjustable carriage and the other bank is mounted in a subframe movable in a second adjustable carriage with the subframe and other bank being urged into engagement with the log under a predetermined contact.

11 Claims, 2 Drawing Figures

APPARATUS FOR PRODUCING SQUARED TIMBERS BY MEANS OF NON-CHIP SEVERING OF BOARDS THEREFROM

BACKGROUND OF THE INVENTION

The present invention is directed to an apparatus for the production of squared timber from round logs by severing or slicing, without forming any cuttings such as chips or sawdust, a series of strips or boards from opposite sides of the log by utilizing two opposed banks of staggered cutting blades. The apparatus will include a feeding device or means for moving the log axially in a longitudinal direction through the oppositely placed banks of cutting blades with the blades in each bank being arranged in staggered relationship with greater penetration into the log or workpiece as the distance along the feed direction increases. The banks of blades are oscillated during the cutting operation and each bank of blades includes a pressure pad immediately preceding a cutting edge of each blade and a guide strip contacting the processed surface of the log being provided immediately ahead of the pressure pad. Preferably, in addition to the pressure pad and guide strip for each blade, a guide strip is also immediately following the last blade in each bank.

An apparatus for producing straight timber from round logs and also from flattened logs and squared timbers so that an central region of the log is processed into a squared timber and the log segments which lie outside of the squared timber are separated into boards at two mutually opposite sides of the log in a non-chip-forming fashion by utilizing a plurality of intermediately succeeding cutting operations spaced along the direction of feed of the log is disclosed in U.S. Pat. No. 4,086,944 which claims priority from German patent application P 25 14 901 and also in U.S. Pat. No. 4,220,185 which claims priority from German patent application P 27 51 238. Reference is made to these two U. S. patents for a more detailed explanation of the structure and positioning of the cutting blades, the structure of the guiding arrangement and feed means, the structure for obtaining the oscillation of the cutting blades and the positioning of both pressure pads and guide strips or pads. Thus, the present application incorporates the disclosure of these two patents by reference thereto.

The lateral separation of boards or strips from a log without forming any chips or sawdust is very desirable for the reasons of waste which is eliminated by the process and the process involves a variety of technical difficulties. If it was not for these difficulties, such a method would otherwise certainly have prevailed earlier in the prior art. One of the greatest problems is obtaining an acceptable, faultless product surface since the risk of premature splitting and tearing of the wood exists given non-chip-forming severing or slicing of the boards by means of a cutting operation with blades having a finite thickness.

In order to avoid this, additional guide strips for each of the banks of blades was proposed in the U.S. Pat. No. 4,220,185. These additional guide strips are disposed between the blades of the bank and the pressure pad which is seated immediately in front of the cutting edge of the next following blade.

Whereas the pressure pads are provided for the purpose of exerting pressure on the surface of the wood in the immediate proximity of the cutting edge of the blade in order to prevent a premature splitting of the next board or strip that is being produced and accordingly only provides a relatively small pressure face, the additionally interposed guide strips have a significantly larger seating surface in comparison to the pressure pads since they are not so much intended to exert a high topical pressure as to guide the workpiece back into the desired alignment before the next severing operation in case the workpiece or log should exhibit a tendency toward lateral excursion, for example, due to differing wood hardnesses at the two sides of the log. It has been shown that an acceptable surface quality of the separated boards can usually not be achieved without using this additional guidance. Further, the guide strips exercise a smoothing effect on the exterior wood surface when it is additionally considered that these guide strips, due to their rigid attachment to the oscillating frame of the bank of blades not only executes a relative motion in the feed direction but over and in addition to this also execute a circular oscillatory motion which at least proceeds at an angle relative to the feed means.

Given the apparatus known from the two above cited patents, the two lateral blade groups or banks are rigidly set to a defined lateral spacing relative to the longitudinal axis of the feed path in accordance with the log diameter which is being processed and also in accordance with the thickness of the squared timber which is to be finally produced. While the U.S. Pat. No. 4,220,185 states that the guide surfaces exert pressure on the log from both sides, it should be noted that this pressure is essentially generated by reaction of the elastic wood material itself. This becomes clear when one examines the arrangement of the blades and the guide strips in the drawings of the patent and also the attached drawings. Given the known manner of proceeding, the guide strips, which are positioned ahead of the first blade, were originally set such that their lateral spacing corresponds to the dimension of the log, which is usually flattened in advance, and the guidance under a defined pressure would be achieved by means of a slight constriction relative to the log diameter. The pressure effect of the other guide strips was defined on the other hand by the graduation of their settings within the blade frame of each bank of blades as well as by the adjustment of the blades. When a specific blade removes more wood than intended, then the contact pressure of the following guide strips will be reduced as a result. On the other hand, the wood has a certain resilient effect so that there is still a pressure effect between the wood and two oppositely disposed guide strips given proper adjustment of the blade and following guide strips.

As may be derived from the above comments, the conditions upon employment of the additional guide strips can continue to be relatively undefined and this condition may have a deleterious effect on the quality of the product being produced. It must also be considered that the difference of the changing pressure of the pressure pads and guide strips also influence their frictional losses on the wood surface and thus influence the power consumption of the oscillating drive of the banks of blades or cutters and has an overall effect on the power consumption of the feed drive.

SUMMARY OF THE INVENTION

It is an object of the present invention to design the conditions for the apparatus so as to be influencable and more constant for the sake of improving the product quality obtained and for the sake of a more cost-favorable operating mode as a result of lower power consumption.

To obtain these results, the present invention is directed to an improved apparatus for producing timber from elongated, round or substantially round timber logs, said apparatus having a feeding means for receiving and advancing the log axially in a longitudinal direction, and processing means for removing portions from the logs without cuttings such as chips or sawdust, said processing means including two spaced opposed banks of staggered cutters or blades that are respectively disposed progressively closer to the longitudinal axis of the log in the direction in advance of the log and means for oscillating said banks of cutters for separating wood sections from the log as the latter is advanced therethrough, each of the cutters of each bank having at least one pressure pad or element disposed immediately ahead of a cutting edge of the cutter or blade in the direction of advance of the log for engaging the log to prevent undesirable splitting and at least one guide located ahead of the corresponding pressure pad and blade for each blade. The improvements comprise first means for mounting a first bank of the two banks rigidly in a frame and second means for mounting the second bank of the two banks opposite the first bank and having means for urging the second bank toward the first bank with a predetermined contact pressure on the surface of the log.

The stroke required for such a contact pressure only needs to be relatively small. For this reason, the two blade banks or groups lying opposite to one another are both expediently disposed on carriages which are displaceable perpendicular to the conveying direction for the purpose of a symmetrical setting of the blade groups depending on the thickness of the log being processed. After determining the spacing, the carriages are then rigidly set for processing the specific wood thickness. The pressable blade group is then advantageously displaceable in addition to the appertaining carriage and relative thereto for the pressure stroke in a transverse direction whereby the pressure drive must attack at the appertaining carriage.

It is expedient for practical reasons to guide the pressable blade group or bank parallel in an adjustable motion. Insofar as individual elements of the movable or pressable blade bank or group are properly adjusted, a satisfactory result is achieved by means of such an execution. Of course, it is also possible to articulate the adjustable bank so as to be pivotable around a perpendicular axis so that the contact pressure is respectively uniformly distributed over the entire length of the blade bank. Given such an execution, however, special measures which respectively consider the conditions upon introduction of a new log into the processing unit would have to be undertaken. Given a parallel guidance of the adjustable blade group, it is sufficient to dispose a sensor for example a light barrier in front or at the forward end of the pair of blade banks which light barrier senses the presence of the log and correspondingly actuates the pressure drive. Different delay times for the pressing or, respectively, release of the pressure drive can be provided and correspond to the feed rate given a light/dark transition corresponding to the beginning of a log and a dark/light transition corresponding to the end of the log.

Given a pivotably seated, adjustable blade bank, it would have to be guaranteed upon introduction at the beginning of a new log that the ends of the two blade groups are not brought too close together before the beginning of the log has reached the end of the blade groups. This could, for example, occur in that the extensible stop keeps the blade group at a specific spacing at the end until the arrival of the beginning of the log is signalled and the stop can be appropriately retracted. It can also be expedient under certain conditions to execute the removable blade bank in sections whereby a parallel guidance can be retained in the adjustment motion but an individual pressure distribution can nonetheless be achieved.

For the pressure means which supplies pressure to move the movable bank, hydraulic or pneumatic cylinders can be utilized. In addition, electromotive or other drives can also be utilized. The return motion of the removable blade group is expediently limited by stops provided on the associated carriage so that the movement stroke can be held within the small degree that is merely required.

It is provided in the preferred embodiment of the apparatus that an additional guide face or surface be provided preceding the first guide strip of each bank and these additional guide surfaces remain at a rigidly set distance from one another regardless of the movement of the pressurized bank of blades. These guide surfaces can be set to be at a fixed spacing required for a specific log diameter and are thus set by means of a symmetrical setting motion for the carriages carrying the blade banks. It is expedient for processing round logs to previously flatten the two lateral faces of the log which proceed between these preceding rigidly set guide surfaces. To this end, therefore, milling heads or millers are also advantageously provided to precede or be in front of the guide surfaces. Matching the guide surfaces, these milling heads are set such that the thickness of the flattened log essentially coincides with the adjusted distance between the guide surfaces. It is not practical to constrict the apparatus so that the first guide strip of the pressable blade bank region still comes into contact with uneven log surfaces. Uniform working of the following blade groups would not be guaranteed under such conditions.

DESCRIPTION OF THE PREFERRED EMBODIMENTS

Figure 1:
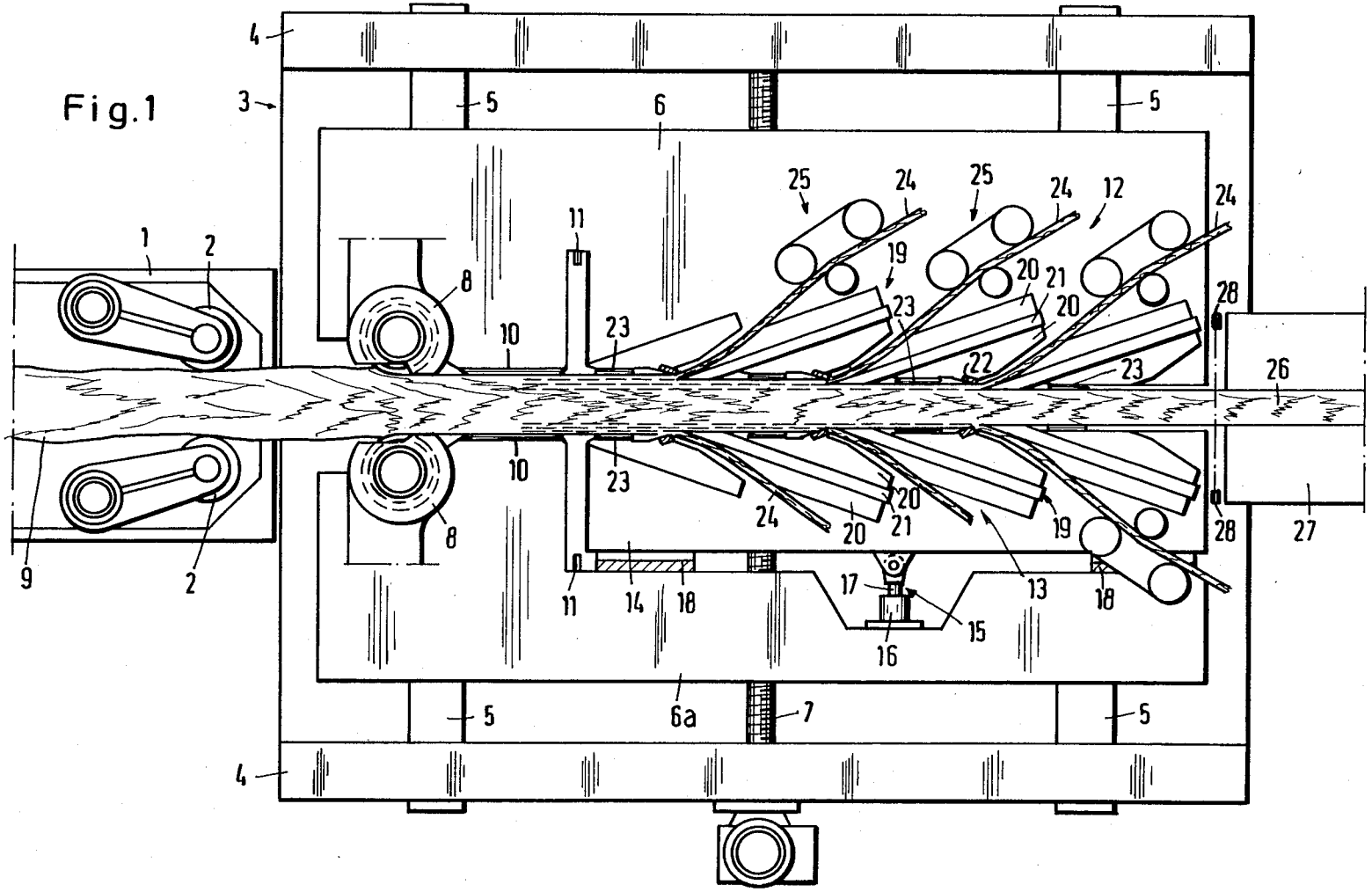
FIG. 1 is a plan view of the apparatus in accordance with the present invention.
Figure 2:
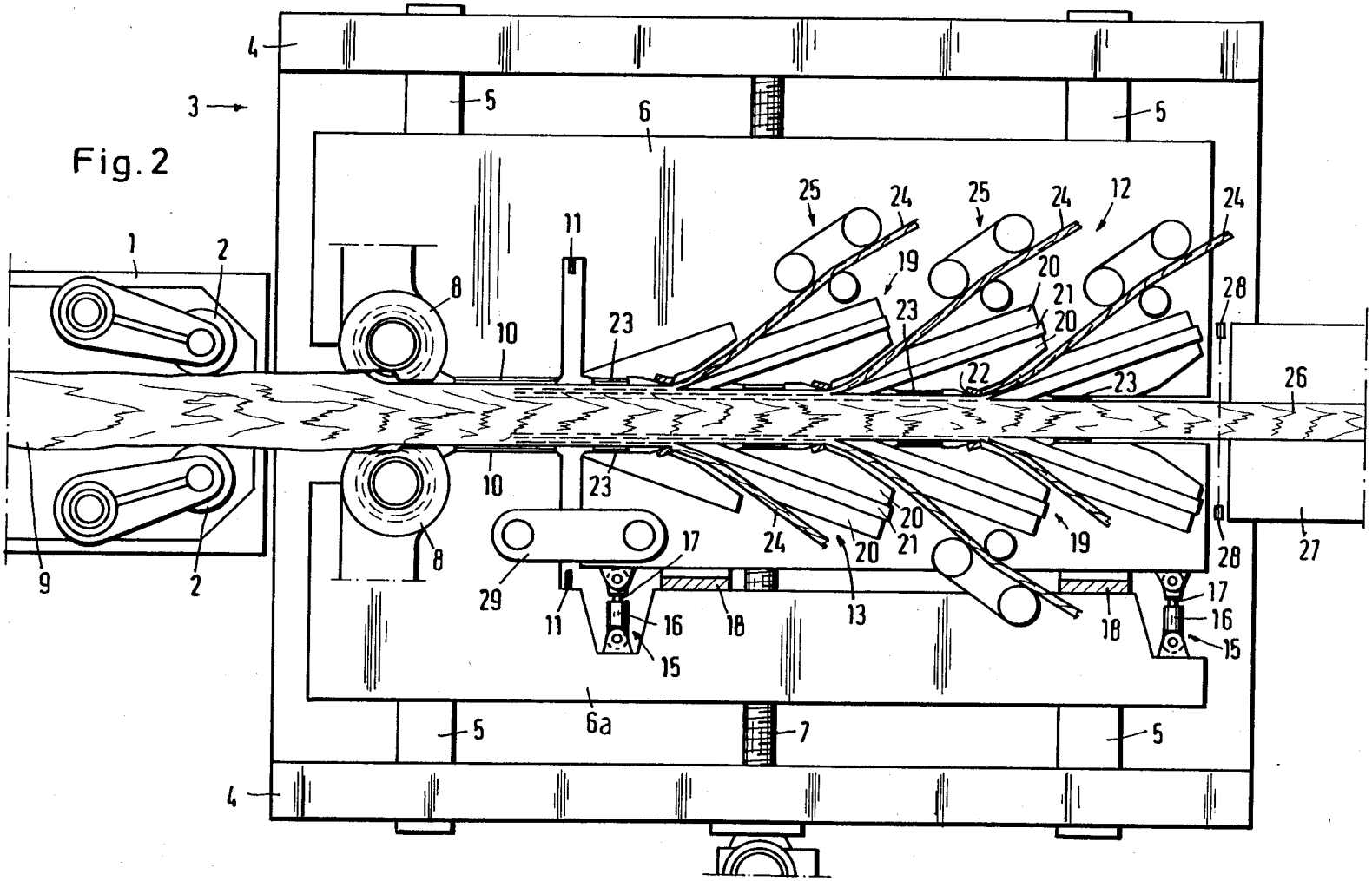
FIG. 2 is a plan view of an embodiment of the apparatus in accordance with the present invention.

The principles of the present invention are particularly useful when incorporated in the apparatus illustrated in FIGS. 1 and 2. The apparatus in FIG. 1 is composed of log feeding means 1, processing means 3 and delivery means 27.

As illustrated, the log feeding means 1 includes a series of driven feed rollers 2 that are disposed in pairs and can be symmetrically pivoted together. In addition, the feeding means 1 may also have a continuous chain which passes beneath both the feeding means 1 and the processing means 3 to facilitate transporting the log such as 9 along its axial extent in a longitudinal direction.

The processing means 3 comprises a base frame 4, which can be provided overall with the oscillatory drive (not shown) for the blade groups or banks in accordance with the disclosures of U.S. Pat. Nos. 4,086.044 and 4,220,185. The base frame 4 contains cross guides 5 on which two carriages 6 can be moved toward and away from each other by means of a spindle drive 7. During movement of the carriages 6 and 6a, they are guided to be parallelly symmetrical relative to the longitudinal axis of the log feeding means. Each of the carriages 6 and 6a at an inlet end which is near the feeding means 1 are provided with milling heads or millers 8 that are rotatably driven on parallel axes which extend perpendicular to the plane of the paper. The milling heads 8 will serve the purpose of flattening the respective lateral faces of the log 9 being processed. The milling heads 8 are each followed by a guide face or surface 10, which is in contact with the flattened sides or surfaces of the log 9. When processing squared timber or, respectively, logs that have already been laterally flattened, the milling heads 8 can be retracted relative to the carriage 6 so that they will not engage the log or block 9 being processed. The guide faces 10 are generally adjustable with respect to the carriage 6 but in interaction with the penetration depth of the miller 8 the surfaces 10 are set to a fixed position on the carriage 6.

As illustrated, the guide faces 10 are followed by a light barrier 11 which, as illustrated, has a receiver attached to one of the two carriages 6 and 6a and a transmitter attached to the other. This light barrier 11 will create a signal when a log is situated in the admission region or entrance of the processing means 3. Immediately following the light barrier 11 are opposed banks 12 and 13 of staggered blades or cutters which are essential elements of the processing means. The bank 12 is rigidly attached to its carriage 6; however, the bank 13 is mounted in a separate frame or subframe 14 which is displaceable through a limited stroke in its carriage 6a. As illustrated, the frame 14 is guided to move in a direction transverse to the direction of feed of the log 9 through the processing device and also perpendicular to the flattened surfaces engaged by the guide faces 10. To insure movement in a a parallel manner and to prevent tilting during movement, a guide structure of parallel extending guides is provided for the subframe 14 to move on its carriage 6a. To shift the frame 14 in the carriage 6a, shifting means such as a hydraulic actuated drive 15, which utilizes a cylinder 16 that is attached to the carriage 6a and a piston rod 17 which is pivotably connected to the frame 14 is provided. Stops 18 are provided on the carriage 6a to limit the return stroke of the frame 14 in the carriage 6a.

Each of the blade banks 12 and 13 is composed of a series of cutting units 19 with each cutting unit comprising a blade or cutter 21 chucked in a blade carrier 20. The blade carrier 20 is respectively provided with a pressure pad 22 and a guide strip 23 which are positioned so that pressure pad 22 is immediately adjacent to a cutter edge of the following cutting blade while the guide strip immediately follows the preceding blade of the particular blade carrier. Such an arrangement was disclosed in the U.S. Pat. No. 4,220,185 with the only deviation being in the region of the first and last blade of each bank.

The processing means 3 also include a delivery and justification system 25, which is provided for each of the blades of each of the banks 12 and 13. The delivery and justification system 25 is provided for pulling the laterally severed boards or strips 24 and to remove the board or strip 24 from the work area on the one hand and on the other hand to cancel the curvature of the board that occurred due to the severing or slicing operation. The remaining squared timber 26 is removed by means of the delivery means 27 which is only schematically illustrated.

During operation of the apparatus, the carriage 6 with the millers 8 and the guide faces 10 are brought together to a defined spacing that corresponds to the diameter of the log 9 to be processed and are locked in this position. The actuating drive 15 of the frame 14 is in a retracted position so that the frame 14 is seated against the stops 18 of the carriage 6a. When, after its two sides have been flattened by the millers 8, a log 9 enters between the guide faces 10 and into the light barrier 11, the light barrier 11 creates a signal indicating a presence of the log and initiates the hydraulic actuating drive 15 to press the bank 13 of blades disposed in the frame 14 against the surface of the log. With operating logs having identical dimensions, the blade group or bank 13 can remain in its preset position so that the logs can be continuously processed without any intervals. Given operation on logs of a different dimension, the frame 14 is moved back to the stops 18 by the actuating drive 15 after the log has cleared the banks 12 and 13 as well as a light barrier 28 provided in the discharge area.

It is significant to point out that the pressure pads 22 comprising a small pressure surface are generally to be set such that they project somewhat more toward the longitudinal axes of the apparatus in comparison to the larger area of the associated guide strip 23. It is thereby guaranteed that the pressure pads 22 always press into the wood in front of the following cutting blade with a definite penetration depth and also with a relatively exact defined contact pressure to obtain a constant cutting condition. The guide strips 23 thereby enclose the log being worked and exert a relatively constant and selectable pressure on the wood from both sides. It has been shown that a product having sufficiently improved qualities can be obtained by means of this measure.

In FIG. 2, a modification or embodiment of the device of the present invention is illustrated. In this modification, two actuating drives 15 are provided. Each of the actuating drives has a cylinder 16 which is pivotally attached to the carriage 6a at spaced positions along the longitudinal direction and each of the drives can be charged with a different force. In order to obtain a distribution of the contact pressure over the entire length of the bank of blades, the latter is pivotably hinged to the carriage 6a by means of an articulation or lever 29 which is mounted to pivot around pivot axes which are perpendicular to the plane of the paper and parallel to the axes for the miller and parallel to the process surfaces of the log 9.

Although various minor modifications may be suggested by those versed in the art, it should be understood that I wish to embody within the scope of the patent granted hereon, all such modifications as reasonably and properly come within the scope of my contribution to the art.

I claim:

1. In an apparatus for producing timbers from elongated round or substantially round timber logs, said apparatus having a feed means for receiving and advancing the log axially in a longitudinal direction, and processing means for removing portions from the log without forming cuttings, said processing means including two spaced opposed banks of staggered cutters that are respectively disposed progressively closer to the longitudinal axis of the log in a direction of advance of the log through the processing means, said processing means including means for oscillating the banks of cutters for separating portions from the log as the log is advanced therethrough, each of the cutters of each of the banks having a pressure pad immediately adjacent and preceding a cutting edge of the cutter and a guide strip in front of the pressure pad and following the next earlier cutter, the improvements comprising first means for rigidly mounting a first of the two banks of cutters in a frame for adjustment to desired positions and second means for mounting the second bank of cutter in the frame for adjustment opposite the first bank, said second means having means for urging the second bank toward the first bank with a predetermined pressure.

2. In a apparatus for producing timbers from elongated round or substantially round timber logs, said apparatus having a feed means for receiving and advancing the log axially in a longitudinal direction, and processing means for removing portions from the log without forming cuttings, said processing means including two spaced opposed banks of staggered cutters that are respectively disposed progressively closer to the longitudinal axis of the log in a direction of advance of the log through the processing means, said processing means including means for oscillating the banks of cutters for separating portions from the log as the log is advanced therethrough, each of the cutters of each of the bank having a pressure pad immediately adjacent and preceding a cutting edge of the cutter and a guide strip in front of the pressure pad and following the next earlier cutter, the improvements comprising first means for rigidly mounting a first of the two banks of cutters in a frame for adjustment to desired positions and second means for mounting the second bank of cutters opposite the first bank and having means for urging the second bank toward the first bank with a predetermined pressure, said first means for mounting including a first carriage and the second means for mounting comprising a second carriage, said first and second carriages being adjustable at right angles to the axis to the direction of advance through the apparatus to assume symmetrical relations thereto, said second carriage having a subframe receiving the second bank and movable relative to the second carriage for a specific strole at right angles relative to the axis of the direction of advance of the apparatus and said means for urging being pressure means acting between the second carriage and said subframe to urge the second bank toward the first bank.

3. In an apparatus according to claim 2, wherein the subframe moves on parallel extending guides in said second carriage.

4. In an apparatus according to claim 2, wherein the pressure means has a pivotal connection to the subframe to guarantee a uniform pressure over the entire length of the second bank.

5. In an apparatus according to claim 2, wherein the pressure means includes a hydraulic cylinder.

6. In an apparatus according to claim 2, wherein the pressure means includes a pneumatic cylinder.

7. In an apparatus according to claim 2, wherein the pressure means includes an actuating cylinder having control means including a sensor creating a signal in response to a log being advanced into the processing means.

8. In an apparatus according to claim 2, wherein each of the carriages at an end in front of the bank has a guide surface for engaging a flat surface of the log, said guide surfaces being arranged symmetrical to the axis of advance for the feed means independent of the actuation of the pressure means.

9. In an apparatus according to claim 8, wherein each of the carriages has a miller arranged adjacent to an entrance of the processing means forward of the guide surface, said miller laterally flattening the log as it enters the processing means.

10. In a apparatus according to clalm 1, wherein each of the pressure pads extend a limited distance toward the longitudinal axis of the feed means by a greater amount than the associated guide strip so that the pressured pad exerts a force on the log as the associated cutter is severing a portion therefrom.

11. In an apparatus for producing timbers from elongated round or substantially round timber logs, said apparatus having feed means for receiving a log and advancing the log axially in a longitudinal direction, and processing means for removing portions from the log without creating cuttings, said processing means including two spaced, opposed banks of staggered cutters, each bank having the cutters disposed progressively closer to the longitudinal axis of the log in the direction of advance of the log through the processing means, said processing means including means for oscillating said banks of cutters for separating portions from the log as the later is advanced therethrough, each of the cutters having a pressure pad positioned adjacent and immediately before a cutting edge thereof for engaging the log to prevent undesired splitting and a guide surface located ahead of the corresponding pressure pad, the improvements comprising a first bank of the two banks of cutters being rigidly mounted in a first carriage adjustably received in a frame, a second carriage adjustably mounted in said frame opposite said first carriage, the second bank of the two banks of cutters being rigidly mounted in a subframe movably received in said second carriage for movement through a limited stroke transverse to the longitudinal axis of the feed means and pressure means for selectively urging the subframe and second bank in said second carriage and toward the first bank under a predetermined pressure.

* * * * *